United States Patent [19]

Thomas et al.

[11] Patent Number: 4,542,530

[45] Date of Patent: Sep. 17, 1985

[54] FLEXIBLE CONTAINER WITH RESEALABLE OPENING

[75] Inventors: Geoffrey Thomas; Charalambos G. Kalkipsakis, both of Auburn, Australia

[73] Assignee: Wrightcel Limited, Auburn, Australia

[21] Appl. No.: 336,954

[22] Filed: Jan. 4, 1982

[30] Foreign Application Priority Data

Jan. 7, 1981 [AU] Australia ..... PE7160

[51] Int. Cl.[4] ..... B65D 33/16

[52] U.S. Cl. ..... 383/66; 383/93

[58] Field of Search ..... 150/8, 9; 229/62; 383/66, 93

[56] References Cited

U.S. PATENT DOCUMENTS 3,642,047 2/1972 Waage ..... 150/8

4,257,535 3/1981 Mellett ..... 150/8 X

*Primary Examiner*—Donald F. Norton

*Attorney, Agent, or Firm*—Irons & Sears

[57] ABSTRACT

A flexible container for the storage of liquids which incorporates a resealable opening. A flap is temporarily sealed over the opening of the unfilled flexible container. When the container is filled this temporary seal is broken and after filling a permanent heat seal is formed by applying heat externally to the flexible container. The flap is heat sealable on the surface contacting the opening in the container wall but non-heat-sealable on its opposite surface. The temporary seal is preferably a heat activated or pressure sensitive coating which has a low cohesion with the opening of the flexible container wall.

2 Claims, 3 Drawing Figures

FLEXIBLE CONTAINER WITH RESEALABLE OPENING

Figure 1:
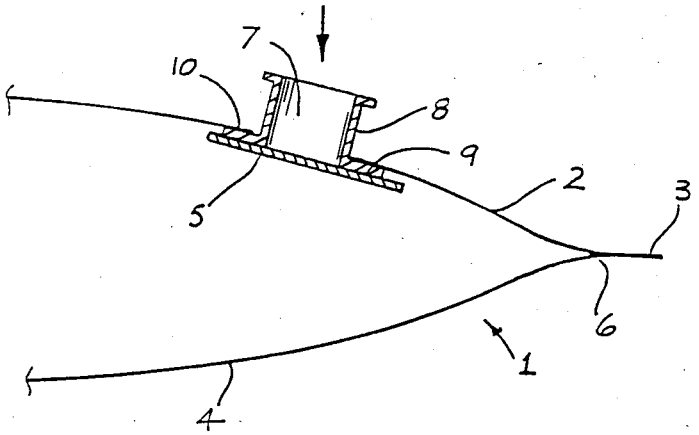

This invention relates to improvements in bulk flexible containers of the kind used in storing liquids. In particular the present invention relates to flexible containers of the kind described in Australian Pat. No. 47367/79. The counterpart U.S. Patent to Australian Pat. No. 47367/79 is U.S. Pat. No. 4,257,535 issued Mar. 24, 1981 to inventior Lee T. Mellett.

That specification described a bulk container of the type having a flexible container housed within an outer, relatively rigid, box-like structure said flexible container having collar means affixed thereto and extending through a wall of the outer box, the collar means being capable of accommodating dispensing means; said flexible container further having an internal flap in juxtaposition with said collar means, said flap comprising a first heat-sealable surface and a second non-heat-sealable surface, the first and second surfaces facing towards and away from the dispensing means, respectively; the arrangement being such that said flexible container is capable of being filled through the collar means, and when the bag is full heat may be applied to the bag in the region of the flap so that said first surface of the flap becomes heat sealed to the collar means, thereby providing an air-impermeable rupturable diaphragm which can be ruptured on accommodation of the dispensing means within said collar means.

A problem encountered with the flexible container described in specification No. 47367/79 was that the container was not sealed until after filling and consequently unless the container was filled immediately after manufacture the inside of the bag was unlikely to be sterile and it was difficult to prevent some accumulation of air into the bag. This meant that the flexible containers required sterilization prior to filling and that the containers need to be evacuated prior to filling, particularly where the presence of air in association with the liquid contents is to be avoided.

To overcome this problem the present invention provides a flexible container having affixed to one side wall a collar means capable of accommodating a dispensing means, said collar means being closed by a flap which is temporarily sealed to the surrounding edges of said collar to seal the container, said flap having a portion of its surface in contact with the edges of said collar permanently sealable thereto, while the opposite surface of said flap is non-heat-sealable to the material of the container wall.

By providing a temporary seal the flap seals the container immediately following manufacture and retains the internal surfaces of the container in a sterile condition. The temporary seal is preferably a low tack sealable layer on the flap. Further because the container is formed and the flap temporarily sealed while there is virtually no air within the sealed container, this condition is maintained during its stored life. When the container is to be filled, the liquid is forced into the collar and the pressure of the liquid is appropriately high enough to break the temporary seal. After the container is filled the flap is subjected to heat and pressure to weld the flap to the collar in the region of the flap which is permanetly sealable (preferably heat-sealable) to the collar.

In the present invention it is not necessary for the flap to be attached to the wall of the container. It can be partially welded to the collar or the container wall immediately surrounding the collar and the remaining portion of the contacting surface can be peelably adhered. By providing a tack sealable polymeric coating over portion of the flap this portion will not be welded when the flap is heat-sealed to the container wall or collar. The polymeric coating is either pressure or heat activated to become adhesive. The polymeric coating results in a light adhesion of the flap to the collar which adhesion can be broken by the pressure of the liquid dispensed from the filling machine. Where a heat activated coating is used the preferred lacquer is an ethylene vinyl acetate based polymeric product sold under the brand name Adcote 3391A by Morton Chemicals. Preferred pressure sensitive products are those based on acrylic or natural rubber formulations which are commercially available.

Figure 2:
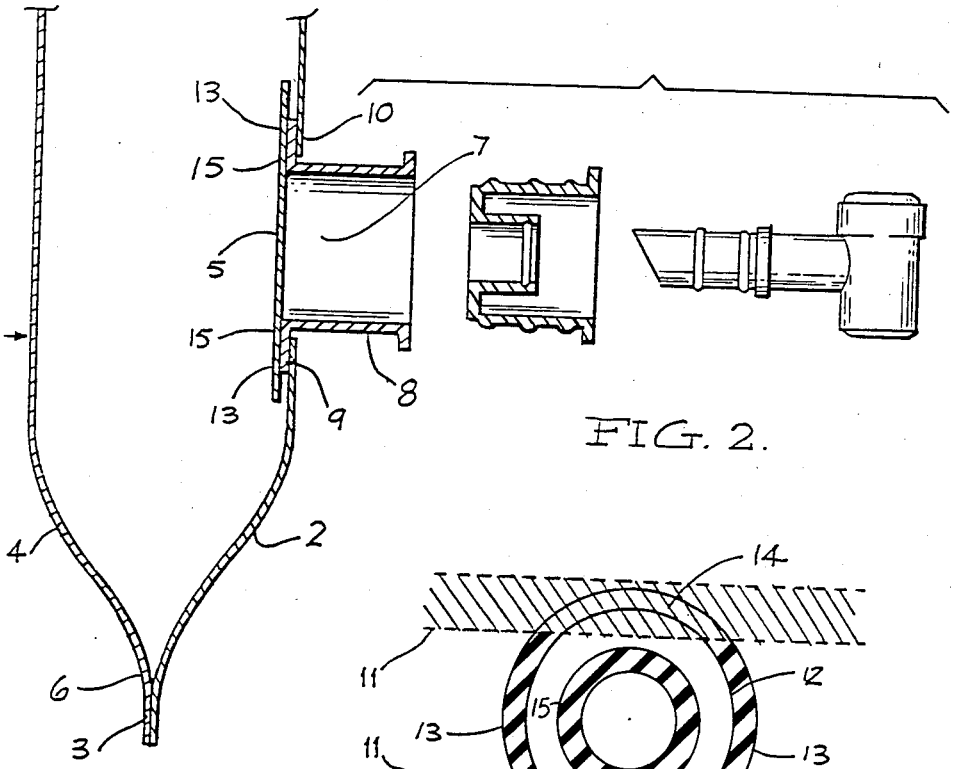
Figure 3:
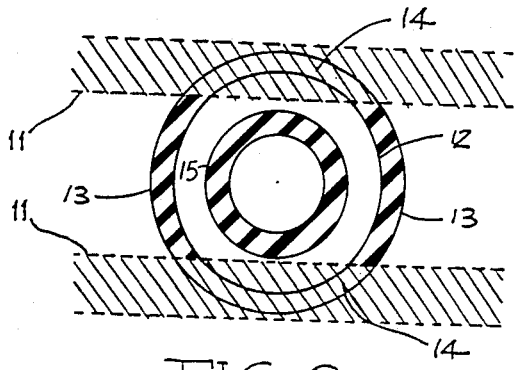

A preferred form of the invention will now be described with reference to the drawings in which FIG. 1 illustrates a part of a flexible bag in accordance with the invention, during the course of filling;

FIG. 2 illustrates the same part, after filling, and sealing of the flap in association with a dispensing tap, and FIG. 3 illustrates the various sealing regions about the collar.

Referring to FIG. 1, the bag—generally designated as 1—comprises a wall 2 heat sealed at the periphery 3 to the lower wall 4. The flap 5 extends across an opening 7 in the flexible container wall 2 into which fits a collar 8. The flange 9 of collar 8 is heat sealed to the periphery 10 of the opening and the flap 5 is sealed to the collar 8. As mentioned above the collar 8 can easily be secured to wall 2 by suitable machinery.

In FIG. 2 in exploded view, is shown the top constructions comprising a tap socket which can be snugly fitted into socket 8 and a tap which includes a piercing pipe that ruptures the flap 5 covering opening 7 when it is secured within the socket which in turn is secured in collar 8.

FIG. 3 illustrates the arrangement for sealing the flap 5 to the flange 9 of the collar 8. As described in specification No. 47367/79 the flap 5 comprises a heat-sealable surface which abuts the flange 9 but has a non-heat-sealable surface on the side which abuts wall 4. On the surface in contact with flange 9 the flap 5 is pretreated with a coating of two strips 11 of a suitable polymer which provides a temporary "peelable seal". Any suitable peelable sealing lacquer of low cohesion strength may be used. When the flexible container 1 is first assembled the flap is sealed to the flange 9 along the perimeter 12 by a heat sealing iron. Because of the coating 11 a heat seal only occurs at region 13 while the flap 5 is lightly adhered to the flange 9 in region 14. During filling the pressure of liquid entering through collar 8 breaks the seal in region 14 and thus enters the flexible container. Subsequent to filling the flap 5 is permanently sealed to flange 9 by heat sealing along the perimeter 15 which completely seals the container.

It can be seen that the present inYention provides the means of providing a flexible container that can be made and subsequently stored in a sterile air free state. This lends itself to use in situations where sterile storage and filling is required with the exclusion of air from the prefilled and filled containers. In particular the absence of air in the container prior to filling means that an evacuation cycle is unnecessary in the filling machinery.

We claim:

1. A flexible container comprising:

(a) a collar affixed by a flange to a wall of said flexible container, said collar providing an opening into said flexible container for filling said container and for receiving a dispensing means after said container is filled; and, (b) a flap attached within said flexible container, said attachment being to or near said flange, so that said flap is over said opening in said collar and a fluid tight seal over said opening can be made, said flap including:

(i) a first surface region which can be brought into contact with said flange, said flange including a first region for providing a temporary seal around said opening with said first surface region on said flap;

(ii) a second surface region which can be brought into contact with said flange, said flange including a second region for providing a fluid tight heat seal around said opening with said second surface region on said flap when heat is applied outside said flexible container in the region of said flap; and, (iii) a second non-heat sealable surface facing away from said collar so that said flap will not be heat sealed to the interior of said flexible container when heat is applied outside said flexible container in the region of said flap.

2. A flexible container as claimed in claim 1 in which the temporary seal between said flap and said flange is made with a peelable polymer layer having low adhesion.

* * * * *